US006094775A

United States Patent [19]

Behmer

[11] Patent Number: 6,094,775

[45] **Date of Patent: *Aug. 1, 2000**

[54] MULTIFUNCTIONAL VACUUM CLEANING APPLIANCE

[75] Inventor: Albin Behmer, Bad Neustadt, Germany

[73] Assignee: BSH Bosch und Siemens Hausgeraete GmbH, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/035,386

[22] Filed: Mar. 5, 1998

[30] Foreign Application Priority Data

Mar. 5, 1997 [DE] Germany ..... 197 08 955

[51] Int. Cl.[7] ..... A47L 5/00

[52] U.S. Cl. ..... 15/329; 15/327

[58] Field of Search ..... 15/328, 329, 327.5

[56] References Cited

U.S. PATENT DOCUMENTS

| | | | |
|---|---|---|---|
| 3,950,814 | 4/1976 | Fleischhauer | 15/327.7 |
| 5,054,157 | 10/1991 | Werner et al. | 15/328 |
| 5,309,600 | 5/1994 | Weaver et al. | 15/329 X |
| 5,524,321 | 6/1996 | Weaver et al. | 15/329 |
| 5,709,007 | 1/1998 | Chiang | 15/329 |
| 5,819,364 | 10/1998 | Sham | 15/329 X |

*Primary Examiner*—Chris K. Moore

*Attorney, Agent, or Firm*—Herbert L. Lerner; Laurence A. Greenberg; Werner H. Stemer

[57] ABSTRACT

The multifunctional vacuum cleaning appliance has a lower housing part provided with an electrically driven brush. A further housing part is allocated to the lower housing part. The further housing part incorporates the operational parts for vacuum generation, dust filtering and dust collection. The lower housing part can be coupled to the suction circuit of the further housing part. In addition to vacuum sweeping work with the complete assembly, the appliance can also be used for normal vacuuming work without spatial limitations because the further housing part is a pull-along cylinder vacuum cleaner which is detachably coupled to the lower housing part.

20 Claims, 1 Drawing Sheet

MULTIFUNCTIONAL VACUUM CLEANING APPLIANCE

BACKGROUND OF THE INVENTION

1. Field of the Invention

The invention relates to vacuum cleaners and, more particularly, to a multifunctional vacuum cleaning appliance which has a lower housing part provided with an electrically driven brush, to which lower housing part there is allocated a further housing part in which the operational parts for vacuum generation, dust filtering, and dust collection are incorporated, and in which cleaning appliance the lower housing part can be coupled to the suction circuit of the further housing part.

2. Description of the Related Art

A vacuum cleaning appliance of that generic type is known from European patent EP 0 388 676. There, the lower housing part and the further housing part, which is designed as a filter cassette for a filter bag and which contains a fan motor, are connected permanently to one another. A movable suction hose is attached to the upper end of the further housing part which can be connected in a detachable manner to a connector on the lower housing part. It is therefore possible for the suction hose to be removed from the connection piece and carrying out special additional vacuum cleaning work. For this purpose, the suction hose can also be coupled to a handheld suction tube which is fitted in a housing recess of the further housing part and which can be taken out of the recess. The prior art cleaning appliance can thus be used not only for vacuum sweeping, but also for normal suction operation. However, in this case, the radius of action is severely limited by the relatively short length of the suction hose and of the handheld tube unless the cleaning appliance is moved. If vacuuming has to be done in an area lying outside this radius of action, the entire cleaning appliance must be correspondingly moved in order to be able to perform vacuuming in that entire area.

SUMMARY OF THE INVENTION

It is accordingly an object of the invention to provide a multifunctional vacuum cleaning appliance, which overcomes the above-mentioned disadvantages of the prior art devices of this general type and which, in addition to the vacuum sweeping, can also be used for normal vacuuming work without spatial limitations and without the need to move the entire vacuum cleaning appliance.

With the foregoing and other objects in view there is provided, in accordance with the invention, a multifunctional vacuum cleaning appliance, comprising:

a lower housing part provided with an electrically driven brush;

an independently functional, pull-along cylinder vacuum cleaner detachably mounted on the lower housing part; the cylinder vacuum cleaner including a suction circuit and operational parts for vacuum generation, dust filtering, dust collection; and means for selectively coupling the lower housing part to the suction circuit of the pull-along cylinder vacuum cleaner.

In other words, the object of the invention is satisfied in that the further housing part is formed as a cylinder vacuum cleaner which is coupled to the lower housing part in a detachable manner. In order to carry out normal vacuuming work, the cylinder vacuum cleaner can be removed from the lower housing part and can be used as a normal cylinder vacuum cleaner.

Since the lower housing part can be connected by way of an electric connection line to an electric power point, and the cylinder vacuum cleaner can be coupled to the electric circuit of the lower housing part via an electric plug arrangement, no additional connection line is needed for electrically powering the cylinder vacuum cleaner.

In accordance with an added feature of the invention, there is provided an electric connection line for connecting an electric circuit of the lower housing part to an electric mains, and means for electrically coupling the cylinder vacuum cleaner to the lower housing part.

In accordance with an additional feature of the invention, the coupling means is formed on the cylinder vacuum cleaner and on the lower housing part such that an electrical contact is automatically established when the cylinder vacuum cleaner is coupled to the lower housing part.

In accordance with another feature of the invention, the coupling means is an electrical plug adapter automatically plugging the cylinder vacuum cleaner into the lower housing part.

In accordance with a further feature of the invention, the adapter part includes a plug configuration which, upon being disposed on the lower housing part, is connected to the electric circuit of the lower housing part and wherein the adapter part includes a socket, electrically connected to the plug configuration, for a connection line of the cylinder vacuum cleaner.

The plug configuration on the lower housing part and on the housing of the cylinder vacuum cleaner is particularly advantageous. The plug configuration automatically establishes a contact when the cylinder vacuum cleaner is coupled to the lower housing part. This obviates the need for separate connection of the cylinder vacuum cleaner to an electric mains.

A special adaptation of the lower housing part and cylinder vacuum cleaner is rendered superfluous by the fact that the cylinder vacuum cleaner can be coupled to the lower housing part by means of an adapter part, and an adapter plug configuration is provided on the adapter part for connecting the cylinder vacuum cleaner to the electric circuit of the lower housing part.

Likewise, it is possible to dispense with a special electric plug on the housing of the cylinder vacuum cleaner if the adapter part, when arranged on the lower housing part, can be connected, by means of a plug configuration, to the electric circuit of the lower housing part and has a socket, connected to this plug arrangement in an electrically conducting manner, for the connection line of the cylinder vacuum cleaner.

In accordance with a concomitant feature of the invention, the coupling means include a connection nozzle on the lower housing part and a suction hose connected to a suction opening of the cylinder vacuum cleaner. Coupling of the lower housing part to the suction circuit of the cylinder vacuum cleaner is thus rendered particularly easy.

The invention may be defined as an improved multifunctional vacuum cleaning appliance of the type having a lower housing part with a driven brush, and a further housing part operatively associated with the lower housing part, the further housing part incorporating the operational parts for vacuum generation, dust filtering and dust collection, and wherein the lower housing part is couplable to a suction circuit of the further housing part. The improvement comprises: the further housing part is an independently operational pull-along cylinder vacuum cleaner which is detachably coupled to the lower housing part.

Other features which are considered as characteristic for the invention are set forth in the appended claims.

Although the invention is illustrated and described herein as embodied in a multifunctional vacuum cleaning appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
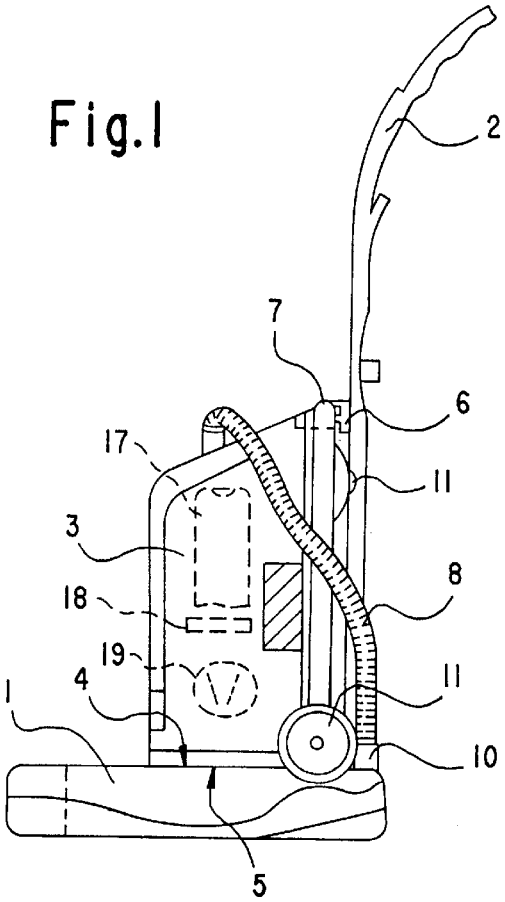
FIG. 1 is a side elevational view of a vacuum cleaning appliance consisting of a lower housing part and of a cylinder vacuum cleaner coupled to the latter.
Figure 2:
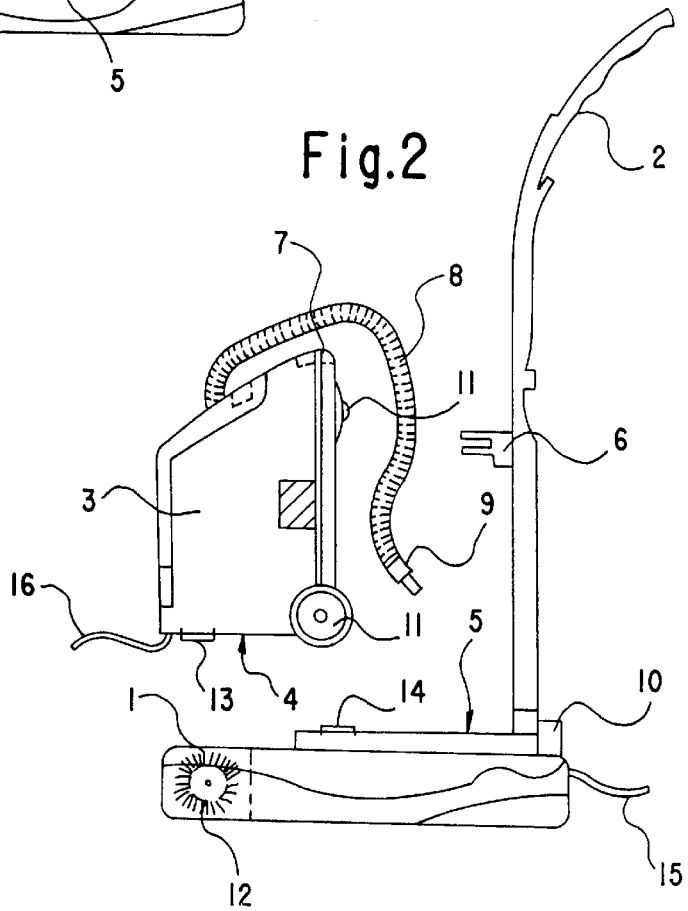
FIG. 2 is a similar view showing the lower housing part and the cylinder vacuum cleaner separated from one another.

Referring now to the figures of the drawing in detail and first, particularly, to FIG. 1 thereof, there is seen a lower housing part 1 which, by means of a steering handle 2 secured on it, can be moved across a surface to be cleaned in a vacuuming operation. A brush roller 12 driven by an electric motor is provided in the lower housing part. A pull-along cylinder vacuum cleaner 3 is detachably disposed on the lower housing part 1. The cylinder vacuum cleaner 3 is an independently functional assembly with a suction circuit and conventional operational parts for dust collection 17, filtering 18, and vacuum generation 19. The cylinder vacuum cleaner 3 rests via its rear surface 4 on a top surface 5 of the lower housing part 1. A holding element 6 is disposed on the steering handle 2. A gripping piece provided on the front face 7 of the cylinder vacuum cleaner 3 forms a snap connector together with the holding element 6 so that the cylinder vacuum cleaner 3 is adequately secured in position on the lower housing part 1.

An electrical plug adapter 13 is disposed on the rear face 4 of the cylinder vacuum cleaner which can be coupled to a mating plug adapter 14 on the top 5 of the lower housing part 1. In this way, the cylinder vacuum cleaner 3 is powered via the electric circuit of the lower housing part 1. An electric connection line 15 is provided on the lower housing part 1, through which the vacuum cleaning appliance may be connected to a mains.

A conventional suction opening is formed in the front face 7 of the cylinder vacuum cleaner 3. A connector end of a movable suction hose 8 is connected into the suction opening. A free end 9 of the suction hose attaches to a connection nozzle 10 on the lower housing part 1. In this way, the lower housing part 1 is connected to the suction loop of the cylinder vacuum cleaner 3. The vacuum cleaning appliance can thus be used for vacuum sweeping.

If, on the other hand, vacuuming work is to be carried out which does not require the use of a brush roller, then the cylinder vacuum cleaner 3 is detached from the lower housing part 1. To do this, the snap connection between the holding element 6 and the gripping piece of the vacuum cleaner housing is released and the cylinder vacuum cleaner 3 is lifted off the lower housing part 1. The cylinder vacuum cleaner 3 is then placed on its wheels 11 on the floor and can thus be moved in a known manner for vacuuming across the surface that is to be cleaned. In addition to having the plug adapter 13 on its rear face 4, the cylinder vacuum cleaner 3 is also equipped with its own connection cable 16 with which it can be connected to a mains socket in independent vacuuming mode. Thus, when vacuum sweeping is not required, the cylinder vacuum cleaner 3 can be used for vacuuming without any spatial limitation. It is not necessary to move the entire vacuum cleaning appliance in order to carry out the vacuum cleaning work.

I claim:

1. A multifunctional vacuum cleaning appliance, comprising:

a lower housing part provided with an electrically driven brush;

an independently functional rolling canister vacuum cleaner detachably mounted on said lower housing part; said canister vacuum cleaner including a suction circuit and operational parts for vacuum generation, dust filtering, dust collection; and means for selectively coupling said lower housing part to the suction circuit of said canister vacuum cleaner.

2. The vacuum cleaning appliance according to claim 1, wherein said lower housing part has an electric circuit and which further comprises an electric connection line for connecting said electric circuit of said lower housing part to an electric mains, and means for electrically coupling said canister vacuum cleaner to said lower housing part.

3. The vacuum cleaning appliance according to claim 2, wherein said coupling means is formed on said canister vacuum cleaner and on said lower housing part such that an electrical contact is automatically established when said canister vacuum cleaner is coupled to said lower housing part.

4. The vacuum cleaning appliance according to claim 2, wherein said coupling means is an electrical plug adapter automatically plugging said canister vacuum cleaner into said lower housing part.

5. The vacuum cleaning appliance according to claim 4, wherein said plug adapter includes a plug configuration which, upon being disposed on said lower housing part, is connected to said electric circuit of said lower housing part and wherein said plug adapter includes a socket, electrically connected to said plug configuration, for a connection line of said canister vacuum cleaner.

6. The vacuum cleaning appliance according to claim 2, which further comprises a second electric connection line for connecting an electric circuit of said canister vacuum cleaner to the electric mains.

7. The vacuum cleaning appliance according to claim 1, wherein said lower housing part has a first electric circuit and said canister vacuum cleaner has a second electric circuit and which further comprises a first electric connection line for connecting said first electric circuit of said lower housing part to an electric mains and a second electric connection line for connecting said second electric circuit of said canister vacuum cleaner to the electric mains.

8. An improved multifunctional vacuum cleaning appliance of the type having a lower housing part with a driven brush, and a further housing part operatively associated with the lower housing part, the further housing part incorporating the operational parts for vacuum generation, dust filtering and dust collection, and wherein the lower housing part is couplable to a suction circuit of the further housing part, the improvement which comprises:

the further housing part is an independently operational rolling canister vacuum cleaner having a means for detachably coupling the suction circuit of the further housing part to the lower housing part by a direct connection.

9. The improved multifunctional vacuum cleaning appliance according to claim 8, wherein said lower housing part has a first electric circuit and said canister vacuum cleaner has a second electric circuit and which further comprises a first electric connection line for connecting said first electric circuit of said lower housing part to an electric mains and a second electric connection line for connecting said second electric circuit of said canister vacuum cleaner to the electric mains.

10. The improved multifunctional vacuum cleaning appliance according to claim 8, wherein said direct connection includes a connection nozzle connected to the lower housing part and a suction hose connected to the further housing part, said connection nozzle and said suction hose directly connecting.

11. The vacuum cleaning appliance according to claim 1, wherein said means for selectively coupling includes a connection nozzle on said lower housing part and a suction hose directly connected to said suction circuit of said canister vacuum cleaner.

12. A multifunctional vacuum cleaning appliance, comprising:

a lower housing part having a first electric circuit, an electrically driven brush, and an electric connection line for connecting said first electric circuit to an electric mains;

an independently functional rolling canister vacuum cleaner detachably mounted on said lower housing part, said canister vacuum cleaner including a plurality of wheels, a second electric circuit, a second electric connection line for connecting said second electric circuit to the electric mains, a suction circuit and operational parts for vacuum generation, dust filtering, and dust collection; and means for selectively coupling said lower housing part to said suction circuit.

13. The vacuum cleaning appliance according to claim 1, wherein said canister vacuum cleaner has a plurality of wheels.

14. The vacuum cleaning appliance according to claim 13, wherein one of said plurality of wheels is a roller.

15. The improved multifunctional vacuum cleaning appliance according to claim 8, wherein said canister vacuum cleaner has a plurality of wheels.

16. The improved multifunctional vacuum cleaning appliance according to claim 15, wherein one of said plurality of wheels is a roller.

17. The vacuum cleaning appliance according to claim 1, wherein said lower housing part has a snap connector for detachably mounting said canister vacuum cleaner to said lower housing part.

18. The vacuum cleaning appliance according to claim 17, wherein said snap connector is a holding element and said canister vacuum cleaner has a gripping element for releasably securing said holding element.

19. The improved multifunctional vacuum cleaning appliance according to claim 8, wherein said lower housing part has a snap connector for detachably mounting said canister vacuum cleaner to said lower housing part.

20. The improved multifunctional vacuum cleaning appliance according to claim 19, wherein said snap connector is a holding element and said canister vacuum cleaner has a gripping element for releasably securing said holding element.

* * * * *